United States Patent [19]

Coltrin

[11] 4,074,893

[45] Feb. 21, 1978

[54] FENCE

[75] Inventor: George E. Coltrin, El Monte, Calif.

[73] Assignee: Adams & Coltrin, Inc., Industry, Calif.

[21] Appl. No.: 664,824

[22] Filed: Mar. 8, 1976

[51] Int. Cl.[2] ..... E04H 17/16

[52] U.S. Cl. ..... 256/21; 256/65; 256/69; 403/182; 403/301

[58] Field of Search ..... 256/65, 59, 24, 22, 256/21, 66, 67, 68, 69, 70; 403/182, 286, 300, 301, 302, 305, 205, 80, 341; 211/206, 207, 182; 135/DIG. 9

[56] References Cited

U.S. PATENT DOCUMENTS

| | | | |
|---|---|---|---|
| 258,911 | 6/1882 | Garver et al. | 256/21 UX |
| 626,733 | 6/1899 | Stewart et al. | 256/65 |
| 2,362,856 | 11/1944 | Strunk et al. | 403/182 |
| 2,930,638 | 3/1960 | Morrisey | 256/65 X |
| 3,386,590 | 6/1968 | Gretz | 211/182 X |
| 3,462,021 | 8/1969 | Hawke et al. | 211/182 |

*Primary Examiner*—Wayne L. Shedd
*Attorney, Agent, or Firm*—Boniard I. Brown

[57] ABSTRACT

A fence kit for constructing a fence having upright posts, rails extending between the adjacent posts, and coupling means connecting the rail ends to the adjacent posts in a manner which permits assembly of the kit into a fence without welding or special tooling. The coupling means for each fence rail comprise collars slidable on the adjacent fence posts, means such as a socket on one collar for slidably receiving the adjacent rail end in its endwise direction, and a radially projecting lug on the other collar to be coaxially aligned with the adjacent rail end and a sleeve slidable on the lug and rail to and from a position wherein the sleeve bridges the lug and rail, whereby the fence may be constructed by first securing the fence posts in their upright positions and then installing the rails between the posts.

12 Claims, 4 Drawing Figures

10
12
14
16
18
20
22
24
26
32
42
A
B
2

10
12
14
16
18
24
26
30
32
34
36
38
40
42
A
B 20
24
30
32
34
36
38
40
42
B

24'
34
36'
38

FENCE

BACKGROUND OF THE INVENTION

1. Field of the Invention

This invention relates generally to fencing, especially wrought iron fencing, and more particularly to a novel fence construction and a fence kit for constructing the fence without welding or special tooling.

2. Prior Art

The present invention is concerned primarily with wrought iron fencing and will be described in this context. As will become apparent from the ensuing description, however, the invention may be utilized to provide a fence kit for constructing a fence of materials other than wrought iron and hence should not be regarded as limited in application to wrought iron fences.

Wrought iron fencing is widely used because of its strength, durability, and, most important, its artistic or ornamental appearance. In this latter regard, it is well recognized that wrought iron fencing may be constructed in a variety of artistic or ornamental design which are not only highly pleasing in appearance but also completely practical as well.

Simply stated, a wrought iron fence comprises a basic supporting structure including upright posts which are anchored in the ground or otherwise secured in their upright positions and upper and lower rails extending between and secured to the posts. In addition to this basic fence structure, a wrought iron fence has upright ornamental bars or the like secured at intervals to the rails and scroll-like shapes or the like secured to the structure, primarily to provide or enhance the ornamentation of the fence.

This invention is concerned primarily with the basic supporting structure of such a fence and more particularly with the attachment of the fence rails to the fence posts. Heretofore, it has been common practice to accomplish this attachment by welding the rails to the posts. This method of attachment, however, suffers from the disadvantages of relatively high cost and excessive time consumption owing to the difficulty or impossibility of prefabricating the fence at the factory and the necessity of dispatching a welding crew to each fence installation site. Accordingly, a definite need exists for an improved technique of wrought iron fence construction.

A variety of non-welded coupling arrangements have been devised for joining members, of course. Examples of such couplings are found in U.S. Pat. Nos. 2,930,638 and 3,353,853. These couplings, however, are not suitable for fences of the kind described.

SUMMARY OF THE INVENTION

This invention provides a novel fence kit which may be totally prefabricated at the factory and assembled into a fence at the job site without welding equipment or other special tooling or skilled technicians. As noted earlier, the invention is particularly adapted to and will be described in connection with the construction of wrought iron fencing but may be adapted to fence construction from other materials.

The fence kit of the invention comprises a plurality (two or more) of posts to be secured in upright positions with the posts arranged in a row, a rail for extension between each pair of adjacent posts, and coupling means for connecting the ends of each rail to the adjacent posts. As will appear from the description, the posts are first secured in their upright positions, as by anchoring the lower post ends in the ground or to some other supporting structure, with a given spacing between the adjacent posts greater than the lengths of the corresponding rails. The rails are then installed between the secured posts.

The primary contribution of the invention resides in the coupling means for connecting the fence rails to their adjacent fence posts. According to the invention, the coupling means for one end of each rail comprises a collar slidable on the respective post and means on the collar for slidably receiving the rail end in its endwise direction. In the particular inventive embodiment described, this rail end receiving means comprises a socket means for slidably receiving the rail end, which socket means may be either a tubular socket member welded or otherwise rigidly attached to the coupling collar or a sleeve slidable on a lug rigid on the collar and projecting beyond the lug for slidably receiving the rail end. The coupling means for the other end of each rail comprises a collar slidable on the respective post, a lug on the collar, and a sleeve slidable on the stud and rail end to and from a position wherein the sleeve bridges the lug and rail. The rail ends are secured to their respective coupling means by screws or other similar fastening means.

The particular fence comprises several fence posts, certain of which, referred to as line posts, are located between and connected to adjacent rails, and one of which posts, referred to as an end post, is located at the bed of the post row. The coupling means for connecting each pair of adjacent rails to the intervening line post have a common collar on the line post. This common collar includes a socket means for slidably receiving the end of one adjacent rail and a lug and sleeve coupling for the end of the other adjacent rail.

The fence kit is assembled into a fence by first securing the posts in their upright positions with the proper spacing between the posts. The rails are then installed between the posts by placing the collars on the posts, engaging one end of each rail with the rail receiving means on one of its collars, aligning the other end of the rail with the lug on the other of its collars, and sliding the corresponding coupling sleeve to its bridging position on the lug and rail.

DESCRIPTION OF THE PREFERRED EMBODIMENT

Figure 1:
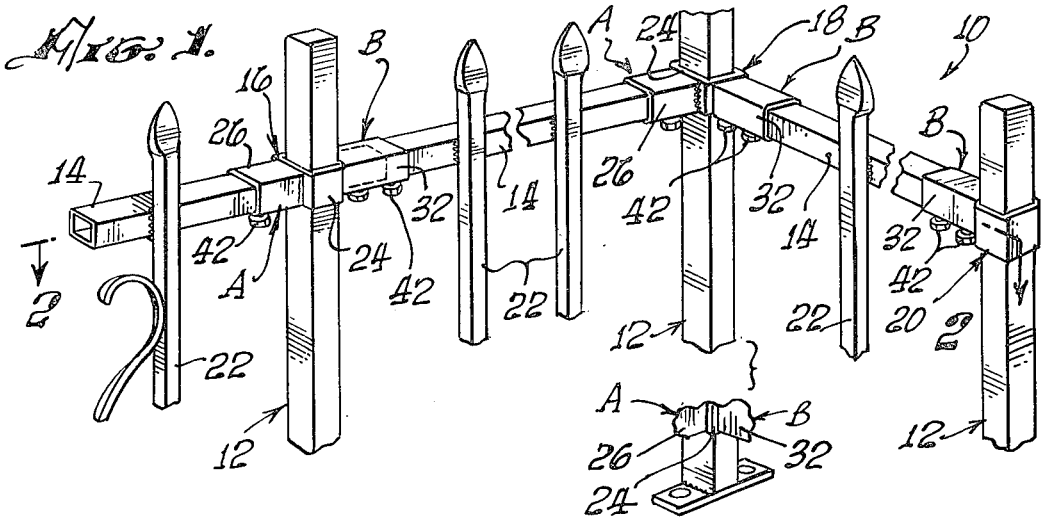
FIG. 1 is a fragmentary perspective view of a wrought iron fence constructed from a fence kit according to the invention.

The wrought iron fence 10 illustrated in the drawings is constructed from a fence kit according to the invention. This fence kit comprises fence posts 12 to be secured in upright positions, rails 14 for extension between the adjacent posts, and coupling means 16, 18 and 20 for connecting the rail ends to their adjacent posts. In this instance, the posts and rails comprise rectangular wrought iron tubes or channels, i.e., box channels. The actual fence kit for constructing the illustrated fence will comprise a pair of upper and lower rails 14, rigidly joined by vertical bars or stakes 22, for extension between each pair of adjacent posts 14, and coupling means 16, 18, 20 for both the upper and lower rail ends. For the sake of clarity, only the upper rails and the upper ends of the stakes are shown in FIG. 1.

The fence kit and fence of the invention will now be described in more detail by considering, first, only a single pair of adjacent posts 12 and a single rail 14 for extension between the posts, namely the two upper posts and the intervening rail in FIG. 2. When thus considered, the fence kit comprises the two posts, the rail, and coupling means for connecting the rail ends to the posts. These two rail end coupling means are designated as A and B in the drawings. As will appear from the ensuing description, the rail end couplings A, B for adjacent rails comprise the fence kit coupling means 16, 18, 20.

Figure 2:
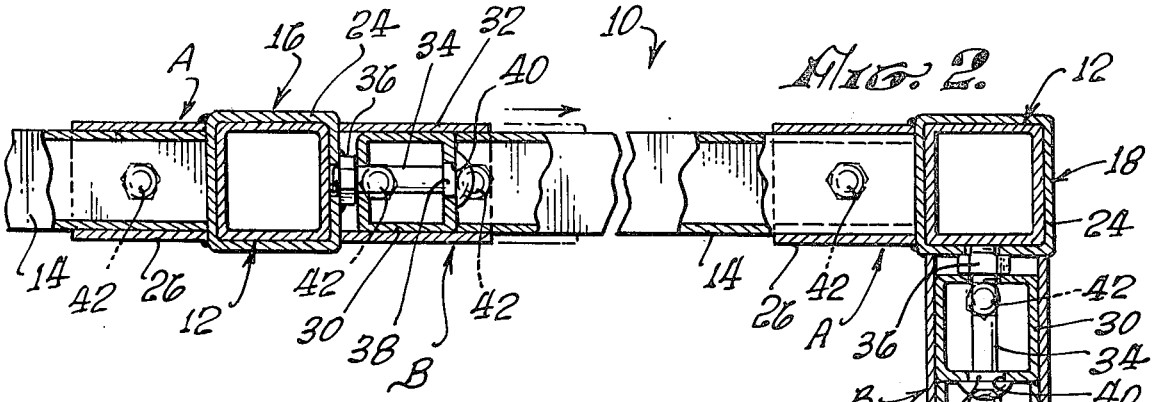
FIG. 2 is an enlarged section taken on line 2—2 in FIG. 1.
Figure 3:
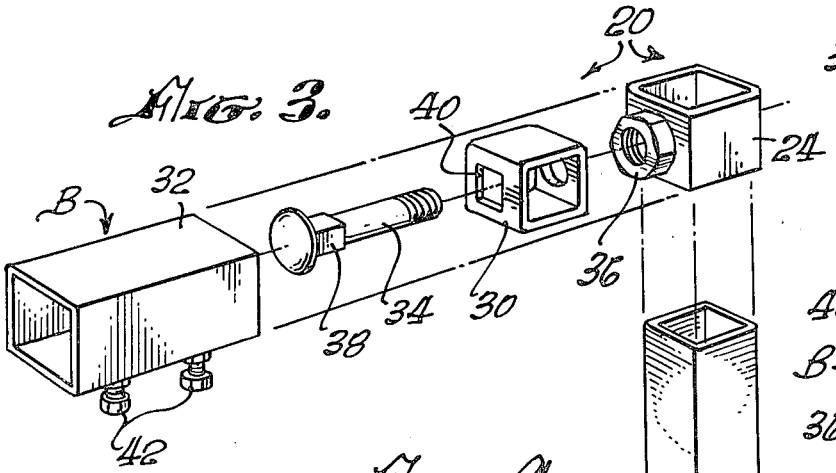
FIG. 3 is an exploded fragmentary perspective detail of the fence.

Turning to FIG. 2, the rail end coupling means A comprises a collar 24 slidable on the adjacent post 12 and means 26 on the collar for slidably receiving the adjacent end of rail 14 in its endwise direction. The particular rail end receiving means 26 shown comprises a socket means opening radially of the collar 24 for slidably receiving the rail end. This socket means consists of a tubular socket member welded or otherwise rigidly joined at one end to the collar. The rail end coupling means B comprises a collar 24 slidable on the adjacent post 12, a radially projecting lug 30 on the collar to be coaxially aligned with the adjacent end of rail 14, and a sleeve 32 slidable on the lug and rail to and from its solid line position of FIG. 2, wherein the sleeve bridges the lug and rail, as shown, to effectively connect the rail to the collar. The rail is releasable from the collar by retracting the sleeve to its broken line position of FIG. 2, wherein the sleeve is withdrawn from the lug onto the rail.

Figure 4:
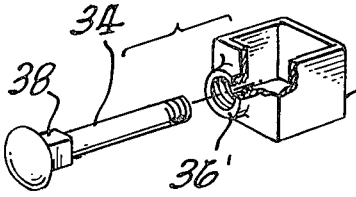
FIG. 4 is an exploded fragmentary detail view of a modified form of the collar component utilized with the fence structure of FIGS. 1 to 3.

In the particular embodiment shown, the lug 30 is separable from its collar 24 and is secured to the collar by a bolt 34. Bolt 34 extends axially through the lug, which is a generally cubic section of box channel, and is threaded in a nut 36 brazed to the side of the collar 24. The bolt has a square shoulder 38 which fits in a mating opening 40 in the lug, whereby the bolt may be turned into and from the nut 36 by rotating the lug. Illustrated in FIG. 4 is a modified collar 24' wherein a threaded opening is formed in the collar member itself, as by punching or exploding and tapping, with no nut being utilized.

Assembly of the above described fence kit structure is accomplished by first securing the posts 12 in their upright positions. The rail 14 is then installed between the posts. Thus rail installation is accomplished by first placing the collar 24 of the rail end coupling means A on one post and inserting one end of the rail, with the coupling sleeve 32 in retracted position at its other end, into the collar socket 26 either before or after placement of the collar on the post, as explained below, such that after such assembly the rail extends from the latter post toward the other post. The collar 24 of rail end coupling means B is then placed on the other post in a position where its lug 30 is coaxially aligned with the rail, and the coupling sleeve 32 is slid to its solid line bridging position of FIG. 2. The parts are secured in this assembled configuration by screws 42 threaded in the socket 26 and the coupling sleeve 32 and adapted to be tightened against the rail 14 and lug 30, as shown.

In connection with the above assembly procedure, it is significant to recall from the earlier description and to observe in the drawings that the rail 14 is sufficiently shorter than the spacing between the posts 12 to permit insertion of the rail into the socket 26 of coupling means A after placement of its collar 24 on the respective post, and placement of collar 24 of coupling means B on the other post with its lug 30 aligned with the rail, as described. Moreover, the rail length may be such as to permit attachment of the lug to its collar after placement of the latter on the post. Prior to securing of the parts in their assembled relation by the screws 42, the rail 14 may be moved axially from the socket 26 toward and against the lug 30, after which the sleeve 32 is extended to its bridging position and the parts are secured in place by the screws.

A fence of the character described has certain posts, referred to herein as line posts, which are located between and connected to two adjacent rails and other posts, referred to as end posts, which are located at the ends of the fence, i.e., at the ends of the row of posts. In the particular fence illustrated, for example, the two left hand posts in FIG. 1 and the two upper posts in FIG. 2 are line posts. The right hand post in FIG. 1 and the lower post in FIG. 2 is an end post. Each of the line post coupling means 16, 18 comprise a rail end coupling means A and a rail end coupling means B having a common collar 24. In the case of coupling means 16, the rail end coupling socket 26 of coupling means A and the coupling lug 30 of coupling means B are coaxially aligned and located at diametrically opposite sides of their common collar 24 for use in a straight fence section. Coupling means 18, on the other hand, is a corner coupling means whose socket 26 and lug 30 are located in a common transverse plane of their common collar 24 but whose circumferential spacing about the collar is other than 180°, in this instance 90° for a right angle corner. The end post coupling means 20 shown is like the rail end coupling means B described above although the coupling means 20 could comprise a socket 26 like coupling means A. In this regard, it will be recognized that the coupling means B is essentially a socket means for slidably receiving the adjacent rail end.

Assembly of the present fence kit into the illustrated fence 10 is accomplished by first securing the posts 12 in their upright positions and then installing the rails 14 between the posts in the manner explained earlier. In this regard, it will be seen that the coupling means 16, 18, 20 are assembled on the posts in such a way that their rail end coupling sockets and lugs are located at corresponding sides of the posts, whereby assembly of the rails on the posts may be accomplished from one end of the fence to the other end. It will be apparent, of course, that the rail end coupling socket of any coupling means may be like socket 26 or like the socket means formed by a lug 30 and coupling sleeve 32.

I claim:

1. A fence comprising:

a plurality of upright posts arranged in a row, a rail extending between each pair of adjacent posts and having a length less than the spacing between the respective posts, first coupling means connecting one end of each rail to the adjacent post comprising a collar slidable on the respective post, and a first coupling sleeve on said collar slidably receiving said one rail end in its endwise direction, and second coupling means connecting the other end of each rail to the adjacent post comprising a collar slidable on the respective post, a radially projecting lug on the latter collar coaxially aligned with said other rail end, and a second coupling sleeve slidable on and disposed in bridging relation to said lug and latter rail end.

2. A fence according to claim 1 wherein:

each first coupling means comprises means securing the respective rail end in the respective coupling sleeve, and each second coupling means comprises means securing the respective coupling sleeve in its bridging position on the respective rail and lug.

3. A fence according to claim 2 wherein:

said securing means comprise threaded fasteners.

4. A fence according to claim 1 wherein:

said lug of each second coupling means is separable from its respective collar, and each second coupling means comprises a screw extending axially through the respective lug for securing the latter to its respective collar.

5. A fence according to claim 1 wherein:

said rail end receiving means of each first coupling means comprises a tubular socket member permanently joined to the respective collar and slidably receiving the respective rail end.

6. A fence according to claim 1 wherein:

said rail end receiving means of each first coupling means comprises a radially projecting lug on the respective collar, and the respective first coupling sleeve is slidable on and bridges said latter lug and the respective rail end.

7. A fence according to claim 1 wherein:

at least one of said posts is a line post situated between two adjacent rails, and the coupling means connecting each line post and its two adjacent rails comprise a common collar slidable on the line post.

8. A fence according to claim 7 wherein:

each line post collar includes the rail end receiving sleeve of the first coupling means for one adjacent rail and the radially projecting lug of the second coupling means for the other adjacent rail.

9. A fence according to claim 8 wherein:

said first coupling sleeve and lug on each line post collar are coaxially aligned and located at diametrically opposite sides of the respective collar.

10. A fence according to claim 8 wherein:

said first coupling sleeve and lug on each line post collar are located in a common transverse plane of the collar axis and spaced circumferentially about the collar by an angle of other than 180°.

11. Post-rail coupling means for a fence kit of the character described including fence posts to be secured in upright positions with the posts arranged in a row and rails for extension between the adjacent posts, comprising:

a collar to be slidably positioned on a fence post, a radially projecting sleeve on said collar for slidably receiving one end of one adjacent rail, a radially projecting lug on said collar circumferentially spaced about the collar from said sleeve to be coaxially aligned with one end of the other adjacent rail, and a second sleeve slidable on said lug and movable to a position wherein one end of said sleeve seats against said collar and the opposite end of said sleeve extends axially beyond the lug for slidably receiving said one end of said other adjacent rail.

12. Coupling means according to claim 11 wherein:

said lug is separable from said collar, and a screw extending axially through said lug for securing the latter to said collar.

* * * * *